United States Patent [19]

Paden et al.

[11] 4,070,734

[45] Jan. 31, 1978

[54] LOCKING MEANS FOR BALING WIRE

[76] Inventors: Ernest D. Paden, 6873 Center Road, Valley City, Ohio 44280; James E. Antolik, 6231 Sylvia Drive, Brookpark, Ohio 44142; Keith W. Boldman, 26715 Bruce Road, Bay Village, Ohio 44140

[21] Appl. No.: 602,559

[22] Filed: Aug. 7, 1975

[51] Int. Cl.[2] ..... B65D 63/00

[52] U.S. Cl. ..... 24/28; 24/16 R; 24/19

[58] Field of Search ..... 24/16 R, 19, 28, 129 B; 339/256 R, 260

[56] References Cited

U.S. PATENT DOCUMENTS

| | | | |
|---|---|---|---|
| 1,150 | 11/1809 | Simmons et al. | 24/16 R UX |
| 281,490 | 7/1883 | Grader | 24/28 UX |
| 357,989 | 2/1887 | Gunckel | 24/28 |
| 439,657 | 11/1890 | Hentz | 24/28 |
| 964,352 | 7/1910 | Wheeler | 24/28 |
| 1,983,776 | 12/1934 | Rosenthal | 339/260 X |

FOREIGN PATENT DOCUMENTS

| | | | |
|---|---|---|---|
| 822,224 | 11/1951 | Germany | 24/28 |

*Primary Examiner*—Paul R. Gilliam
*Assistant Examiner*—Victor N. Sakran
*Attorney, Agent, or Firm*—Thomas M. Schmitz

[57] ABSTRACT

A locking means secures together opposite ends of a baling wire for securing bales of compressed material. Predetermined lengths of baling wire are dispensed and wrapped around a bale and secured by a locking means comprising a metal clip having a raised arcuate center portion spaced outwardly from the peripheral supporting member but connected thereto at either end of the raised arcuate portion. Each arcuate connection forms a crotch between the peripheral support member and the raised arcuate member wherein each end of the baling wire passes transversely therethrough and securely locks therein.

1 Claim, 8 Drawing Figures

LOCKING MEANS FOR BALING WIRE

BACKGROUND OF THE INVENTION

The invention pertains to a locking means for securing baling wire and a method of dispensing predetermined lengths of baling wire and baling compressed bales of bulky waste material such as waste paper, cardboard, plastic cartons, and like waste materials.

Disposal of bulky waste material is often achieved by compressing devices such as a vertical baler which operates on the principle of a vertically descending ram that compresses bulky materials. The vertical ram descends rapidly and tightly compresses the bulky material disposed below the ram and resting on a stationary base member. The compacted or compressed bale is secured by baling wire and thereafter removed from the vertical baler and disposed of. Similar compressing devices operative on a horizontal plane can be utilized to produce a compacted bale of waste material that can be secured and baled in accordance with this invention.

Past procedures for securing bales are inadequate in that prefabricated lengths of wire were utilized wherein one end of the wire had prefabricated looped end which consisted of a loop and the distal end of the wire wrapped several times around the feed wire adjacent to the loop. The free end of the wire was threaded through the loop and hand pulled tautly and then twisted several times around the adjacent feed wire portion of the wire. Upon releasing the compressive force of the crushing ram member, however, substantial expansive forces of the compacted bale transmitted substantial tensile force to each baling wire. The excessive tension on the baling wire very often caused the twisted wire knots to unravel and, consequently, failure of that baling wire. Adjacent wire absorbed increased loads and, in turn, failed even though several wires were used originally.

It now has been found that predetermined lengths of baling wire can be dispensed as any desirable length of wire and quickly secured by a simple locking means. Accordingly, the baling wire can be placed under considerable tensile stress or excessive pull by locking opposed ends of the baling wire within the locking means which effectively locks the baling wire and even becomes a more secure locking means upon increasing the tensile forces on the baling wire.

Accordingly, a primary object of this invention is to secure loose ends of baling wire about a compressed bale by securing the wire ends within a formed stamped locking means which locks the wire upon applying tensile stress to the baling wire.

A further object is to provide a method of dispensing baling wires at variable predetermined lengths, surrounding the compressed waste materials with a plurality of the baling wires, and securing the loose ends of each wire by threading the wire ends transversely through laterally spaced portions of the formed locking clip which securely locks the baling wire upon the application of tensile forces applied to the wire.

These and other advantages of this invention will become more apparent by referring to the drawings and the detailed description of the invention.

SUMMARY OF THE INVENTION

A locking means for securing opposed ends of a baling wire comprises a peripheral base portion having a central arcuate portion stamped outwardly from the base but connected to the base at either end of the arc of the raised central member. The connections between the raised arcuate portion and base forms a crotch which locks the baling wire passing transversely between the arcuate member and the base member.

Baling wire is dispensed in predetermined variable lengths which are wrapped around a compressed bale of waste material and secured by the locking clip. Each end of the wire is threaded transversely between the peripheral base and the raised central arcuate member wherein each end of the wire is bent at a right angle around the crotch connection which locks the right angle bend of the wire upon placing tension on the baling wire.

IN THE DRAWINGS

DETAILED DESCRIPTION OF THE INVENTION

Figure 1:
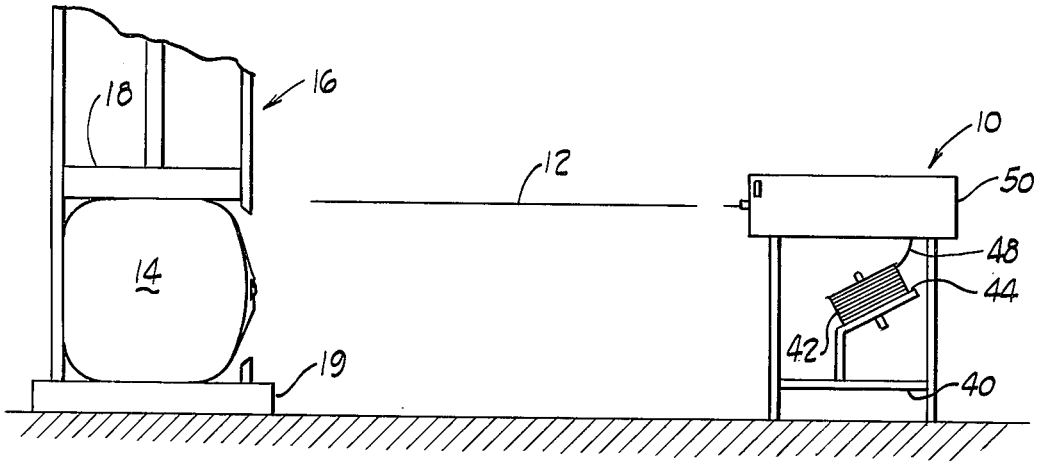
FIG. 1 is a side elevation view of a wire dispensing device dispensing baling wire of predetermined lengths that are wrapped around a bale and secured by a locking means in accordance with this invention.

Referring now to the drawings wherein like characters indicate like parts, shown is a wire dispensing device 10 for dispensing a predetermined length of wire 12 for tightly wrapping a compressed bale 14 of waste material held in compression within a vertical baler 16 having a descending ram member 18 compressing the bale 14 against the stationary base member 19 of the vertical baler 16 for maintaining the bale 14 in compression until secured with baling wire in accordance with this invention.

Figure 2:
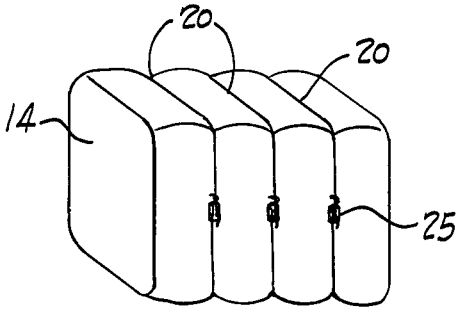
FIG. 2 is a perspective view of a bale secured by baling wire and the wire locking means shown in FIG. 1.

In FIG. 2, the compressed bale 14 is wrapped with a plurality of baling wire straps 20 which tightly secure the compressed bale 14 and are each secured by a formed locking clip 25. The distal ends 22 of each baling wire strap 20 are each secured within the clip 25 which comprises an elongated piece of stamped sheet metal having a continuous outer bracing peripheral frame 27 and an interconnected raised arcuate center portion 29. The raised arcuate center member 29 is intermediately spaced laterally outwardly from the peripheral frame 27 whereas the raised member 29 terminates on either end of the arcuate portion 29 by arcuate connections 31. The arcuate connections 31 each form a narrowing crotch 32 between the raised arcuate member 29 and the peripheral frame 27 wherein the crotch 32 terminates at the arcuate connections 31. The intermediate portion of the arcuate member 29 disposed intermediate to the arcuate connections 31 is spaced laterally outwardly from the peripheral frame 27 at a lateral distance greater than the diameter of the baling wire straps 20 so as to permit easy transverse insertion of the wires 20 between the arcuate member 29 and the peripheral frame 27. Hence, the baling wire straps can be easily inserted transversely between the complementary arcuate member 29 and the peripheral frame 27 and become locked within the crotch 32 therebetween in accordance with this invention. Preferably, the arcuate connections 31 are substantially lateral or forming a right angle with the periphery of the raised portion 29 whereby the crotch 32 is laterally disposed or approximately at a right angle to the baling strap 20 prior to engaging the locking clip 25. The crotch 32 being laterally or horizontally disposed in use assures a secure locking engagement of the baling wire strap 20 within the crotch 32 between the raised center arcuate portion 31 and the peripheral frame 27. The baling wire strap 20 makes a bend of at least about a right angle 35 just prior to entering the crotch 32 to assure a secure lock when the baling wire strap 20 is subsequently placed in tension.

Figure 7:
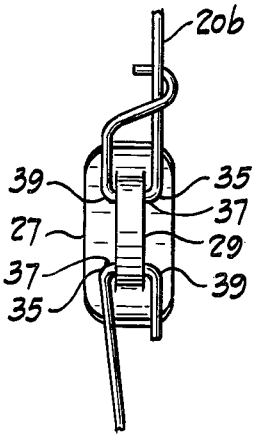
FIG. 7 is a front elevation view of the locking clip with the baling wire locked therein.
Figure 8:
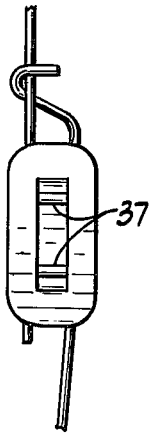
FIG. 8 is a back elevation view of the formed locking clip and baling wire shown in FIG. 6.

Referring now to FIGS. 7 and 8, the baling trap 20 is orientated vertically and passing over the flat peripheral base 27 and under the raised arcuate portion 29 above the arcuate connection 31. The lower wire 20*a* passes horizontally through the crotch 32 between the peripheral frame member 27 and the raised arcuate portion 29. The wire strap 20 must be bent on at least a right angle 35 to secure the wire 20 within the clip 25. In like manner, the upper wire 20*b* descends vertically and passing above the flat peripheral frame 27 and then forms at least a right angle 35 prior to entering the crotch 32 and passing transversely below the arcuate member 29 adjacent to the upper connection 31. The transverse portion 37 of the baling strap 20 passes through the crotch 32 whereupon the transverse portion 37 and the right angle 35 effectively become tightly engaged within the narrowing reaches of the crotch 32 particularly upon applying tension to upper wire 20*b* and lower wire 20*a*. Increased tension in the wire straps 20 due to expansion of the compressed bale 14 after releasing the vertical ram 18 causes even more tighter locking engagement of the baling strap 20 within the narrow crotch 32 wherein the angle 35 and transverse portion 37 of the strap is pulled into the crotch 32 adjacently to the arcuate connections 31. The preferred locking connection includes bending the distal end portions 22 of the baling strap 20 at a second angle 39 which need not be a right angle although quite desirable. As best viewed in FIG. 7, the distal end can be bent downwardly, if desired, as shown with lower wire 20*a* or can be looped around the feed wire 20 such as shown in the upper wire 20*b*.

Figure 3:
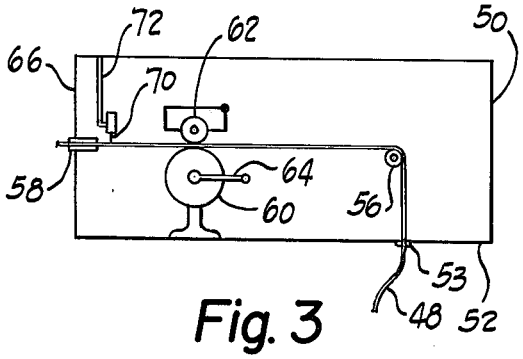
FIG. 3 is a front elevation section view of the wire dispensing device shown in FIG. 1.
Figure 4:
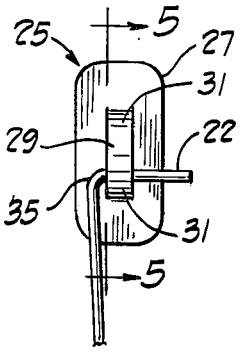
FIG. 4 is an enlarged front elevation view of the baling wire locking means having one end of the baling wire locked therein.
Figure 5:
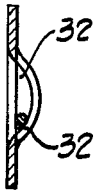
FIG. 5 is a side elevation view of the formed locking means taken along lines 5—5 in FIG. 4.
Figure 6:
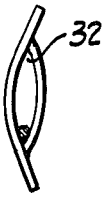
FIG. 6 is an alternative embodiment of FIG. 5.

Referring now to FIGS. 1 and 3, shown is a wire dispensing device 10 having a lower platform 40 supporting a coil 42 of wire on a rotatable wheel 44 skewed on a 45° support 46. The coil 42 is adapted to rotate on the wheel 44 and continuously dispense wire 48 which passes upwardly into an upper chamber 50. The wire 48 passes through the opening 53 in floor 52 of the upper chamber 50 as best shown in the exploded section view of FIG. 3. The wire 48 passing upwardly through the floor opening 53 continues upwardly and around a rearward guide pulley 56 enabling the wire to change course and pass laterally outward. The wire 48 passes forwardly and between a pair of cooperating forward wheels located inside the chamber 50 adjacent to the discharge opening 58 of the chamber 50. The cooperating wheels comprise a lower measuring or tracking wheel 60 and an engaging upper guide wheel 62. The tracking wheel 60 is adapted to accurately track the wire 48 and dispense a predetermined length of wire 12 by revolving the measuring wheel 60 a certain number of revolutions which will dispense a predetermined length of wire 12. The perimeter of the tracking wheel 60 is directly related to the length of wire to be dispensed wherein, for example a revolution of the tracking wheel could dispense one foot of wire 12. The measuring wheel 60 is shown to be operative by a hand crank 64 although the wheel 60 can be readily activated by automatic means such as electronic circuits to control the number of revolutions of the tracking wheel 60. The continuous wire 48 passes laterally outward through an aligned opening 58 in the front wall 66 of the chamber housing 50. Prior to passing through the forward opening, the wire 48 is cut to the predetermined length by a spring loaded knife edge cutter 70 being pivotally mounted to an upper bracket 72 and adapted to cut the wire 48 with a downward movement of the depending cutting edge 70.

The foregoing has been descriptive of a vertically disposed compressed bale that tends to exert expansive forces in a vertical direction. This invention, of course, is applicable to lateraly disposed compressed bales wherein the expansive forces of the compacted bale tend to expand laterally outwardly. In either instance, the baling wire straps surround the bale in the direction adapted to maintain the bale in compression and consequently the baling wire can be easily secured with a locking clip in accordance with this invention to maintain the bale in substantial compression.

In practice, a plurality of predetermined baling wire straps 20 are dispensed and then wrapped around the compressed bale 16 which is maintained in compression. The distal ends 22 of the wire straps 20 are pulled together and secured within clip 25 by bending each wire 20 at a right angle and transversely passing each end above the peripheral frame 27 and below the raised arcuate member 29. Each end 20*a* and 20*b* is pulled tightly into the respective crotch 32 and against the arcuate connection 31 whereby the transverse portion 37 of the wire 20 is locked in the crotch adjacently to the arcuate connection 31. Preferably the distal ends 22 are bent on a second right angle after passing through the crotch 32 and can be further wrapped back around the same lead wire 20, if desired, to securely lock each end 22 of the wire. Upon releasing the compression of the compacted bale 14, considerable tension is applied to the wire 20 whereby each end 22 is locked in tension within the respective crotch 32 of the locking clip 25.

The locking clip 25 provides a quick and efficient means for securely locking baling wire straps by locking the ends thereof within the locking clip and thereafter applying tension to the baling wire. The foregoing is descriptive but not intended to be limiting except as defined by the appended claims.

I claim:

1. A method of securing a compressed bale of compacted waste material, comprising:

providing from a coil of wire a predetermined length of baling wire having free non-twisted distal ends;

wrapping said baling wire around said compressed bale;

locking the opposite free distal ends of said wire with a locking clip having a peripheral frame member and a centrally disposed raised arcuate member interconnected to said peripheral frame at opposed ends of the arcuate member, the raised arcuate member laterally spaced from the peripheral frame forming a first locking crotch therebetween at one arcuate connection and a second locking crotch therebetween at the other arcuate connection for locking the first free end and the second free end of said baling wire passing transversely between said arcuate member and said peripheral frame;

bending each free distal end portion of said baling wire to form at least a right angle adjacently to entering each said crotch, and bending each said free distal end portion into a back-angled bend adjacently to said crotch after transversely passing through said crotch;

releasing the compression on the bale whereby the first and second free ends are locked without twisting within the first and second crotch respectively due to the tension of the baling wire.

* * * * *